United States Patent [19]

Fitzharris et al.

[11] Patent Number: 4,859,310

[45] Date of Patent: Aug. 22, 1989

[54] CATALYTIC CRACKING OF WHOLE CRUDE OIL

[75] Inventors: William D. Fitzharris, Houston; Scott J. Ringle, League City, both of Tex.; Kathy S. Nicholes, Naperville, Ill.

[73] Assignee: Amoco Corporation, Chicago, Ill.

[21] Appl. No.: 173,667

[22] Filed: Mar. 25, 1988

[51] Int. Cl.[4] ..... C10G 37/00

[52] U.S. Cl. ..... 208/87; 208/88; 208/100; 208/103; 208/251 R; 208/355; 208/358

[58] Field of Search ..... 208/100, 102, 103, 80, 208/78, 92, 93, 87, 354, 355, 358, 251 R, 177, 113, 88

[56] References Cited

U.S. PATENT DOCUMENTS

| | | | |
|---|---|---|---|
| 3,591,485 | 7/1971 | Mason, Jr. | 208/78 |
| 3,658,693 | 4/1972 | Hettick et al. | 208/92 X |
| 3,775,290 | 11/1973 | Peterson et al. | 208/92 X |
| 4,082,653 | 4/1978 | DeGrapf | 208/251 R |
| 4,332,673 | 6/1982 | Myers | 208/251 R |

*Primary Examiner*—Glenn Caldarola

*Attorney, Agent, or Firm*—Thomas W. Tolpin; William H. Magidson; Ralph C. Medhurst

[57] ABSTRACT

An effective, economical catalytic cracking process is provided to produce quality gasoline and other hydrocarbons from whole crude oil. The catalytic cracking process is operable and particularly useful during maintenance or shutdown of associated pipestills, vacuum tower, and/or atmospheric tower.

17 Claims, 1 Drawing Sheet

CATALYTIC CRACKING OF WHOLE CRUDE OIL

BACKGROUND OF THE INVENTION

This invention pertains to refining of petroleum and, more particularly, to catalytic cracking of oil.

Catalytic cracking of oil is an important refinery process which is used to produce gasoline and other hydrocarbons. During catalytic cracking, the feedstock, which is generally a cut or fraction of crude oil, is cracked in a reactor under catalytic cracking temperatures and pressures in the presence of a catalytic to produce more valuable, lower molecular weight hydrocarbons. Gas oil is usually used as the feedstock in catalytic cracking. Gas oil feedstocks typically contain from 55% to 80% gas oil by volume having a boiling range from 650° F. to 1000° F. and less than 1% RAMS carbon by weight. Gas oil feedstocks also typically contain less than 5% by volume naphtha and lighter hydrocarbons having a boiling temperature below 430° F., from 10% to 30% by volume diesel and kerosene having a boiling range from 430° F. to 650° F., and less than 10% by volume resid having a boiling temperature above 1000° F.

In conventional catalytic cracking, whole crude oil is separated in a primary pipestill (crude oil unit) or atmospheric tower into fractions of 200° F. and lighter material, naphtha, diesel oil, atmospheric gas oil, and atmospheric bottoms. The atmospheric bottoms are heated in a furnace and separated in a secondary pipestill or vacuum tower into fractions of vacuum naphtha, light vacuum gas oil, heavy vacuum gas oil, and resid. The atmospheric gas oil from the atmospheric tower and the light and heavy gas oils from the vacuum tower and subsequently pumped into the catalytic cracker as a blended composite gas oil feedstock, where it is contacted with fine solid catalyst particles under cracking conditions to crack the gas oil. During cracking, the catalyst becomes coked and deactivated and has to be regenerated in a regeneration vessel. Fresh catalyst is conventionally replaced in the catalytic cracker at a rate of 0.25 pounds per barrel of reactor feed.

Catalytic cracking is an important source of gasoline. From time to time, however, it is necessary to shut down the catalytic cracking unit for days, weeks, or even months to clean, unplug, maintain, uncoke, revamp, and/or repair the pipestill (crude unit) vacuum tower and/or atmospheric tower. When the crude unit is down for maintenance or repair, there is no gas oil feed for the catalytic cracking unit. The catalytic cracking unit would normally be shutdown if gas oil cannot be obtained from another source. Such shutdown deprives the refinery and the consumer of substantial amounts of gasoline. It is also very expensive. Revamp costs and revenue loss to the refinery during shutdown can add up to millions of dollars. Shutdown of the catalytic cracker was, heretofore, required when the pipestills (crude unit), vacuum tower, and/or atmospheric tower were taken offstream for maintenance, revamp, or other work since there was no longer any production of gas oil feedstock from the pipestills (crude unit) and towers. It was generally believed that the catalytic cracking unit could not be operated nor the required heat balance maintained when using unrefined whole crude oil as the feedstock.

Typifying some to the many prior art catalytic cracking units, regenerators, and other refinery equipment and processes are those shown in U.S. Patents: 2,382,382; 2,398,739; 2,398,759; 2,414,002; 2,425,849; 2,436,927; 2,884,303; 2,981,676; 2,985,584; 3,004,926; 3,039,953; 3,351,548; 3,364,136; 3,513,087; 3,563,911; 3,661,800; 3,838,036; 3,844,973; 3,909,392; 4,331,533; 4,332,674; 4,341,623; 4,341,660; 4,332,674; and 4,695,370.

It is, therefore, desirable to provide an improved catalytic cracking process which is operable when the upstream pipestills (crude unit) or towers are taken off line for revamp, maintenance, or to shutdown permanently to consolidate operations.

SUMMARY OF THE INVENTION

An effective catalytic cracking process is provided to produce gasoline and other hydrocarbons. The novel catalytic cracking process is efficient, economical, and safe. It provides an excellent source of good quality gasoline to consumers and is very profitable for the refinery. Advantageously, the novel process is fully operable and is particularly useful when the upstream pipestills (crude unit) or towers are shut down and/or taken off line for revamp, repair, cleaning, decoking, maintenance, etc.

To this end, the novel cataytic cracking process comprises feeding petroleum to a catalytic cracking unit without previously fractionating the petroleum in a pipestill (crude unit), atmospheric tower, or vacuum tower. The petroleum can comprise: raw, uncut, whole crude oil; flashed crude oil; or petroleum containing less than about 50% gas by volume. In the catalytic cracking unit, the petroleum is cracked in the presence of a catalyst in a riser reactor and/or a fluidized bed reactor to more valuable, lower molecular weight hydrocarbons. For enhanced demetallization (removal of metals) of the oil, fresh catalyst can be fed and replaced in the regenerator at an increased rate of up to about 2 pounds per barrel of reactor feed. Coked catalyst is conveyed to a regenerator where it is regenerated and then recycled to the reactor. In order to enhance the environment and minimize pollution, carbon monoxide emitted during regeneration is essentially completely combusted in the regenerator.

Preferably, the composition of the petroleum feed comprises by volume: (a) less than about 35% hydrocarbons comprising naphtha and light hydrocarbons having a boiling temperature less than about 430° F.; preferably less than 400° F.; (b) from about 20% to about 50% hydrocarbons comprising diesel oil and kerosene having a boiling temperature ranging from greater than about 430° F. to less than about 650° F.; (c) from about 20% to less than about 50% hydrocarbons comprising gas oil having a boiling tempreature ranging from greater than about 650° F. to less than about 1000° F.; (d) less than about 20% hydrocarbons comprising resid having a boiling temperature greater than about 1000° F.; and (e) preferably less than 2% RAMS carbon by weight in the petroleum feed. Most perferably, a low resid crude is used with the RAMS carbon content of the resid ranging from about 0.5% to about 10% by weight.

One particularly useful petroleum feedstock is Trinidad crude from the Island of Trinidad. Other useful petroleum feedstocks can comprise: Brass River crude from Nigeria, HIPS crude from Galveston Bay, Texas, Florence Canal crude from Louisiana, St. Gabriel crude from Louisiana, and Louisiana Light crude from Louisiana.

As used in this patent application, the abbreviation "FCCU" means fluid catalytic cracking unit.

A more detailed explanation of the invention is provided in the following description and appended claims, taken in conjunction with the accompanying drawing.

BRIEF DESCRIPTION OF THE DRAWING

The FIGURE is a schematic flow diagram of a catalytic cracking process in accordance with principles of the present invention.

DETAILED DESCRIPTION OF THE PREFERRED EMBODIMENT

Figure 1:
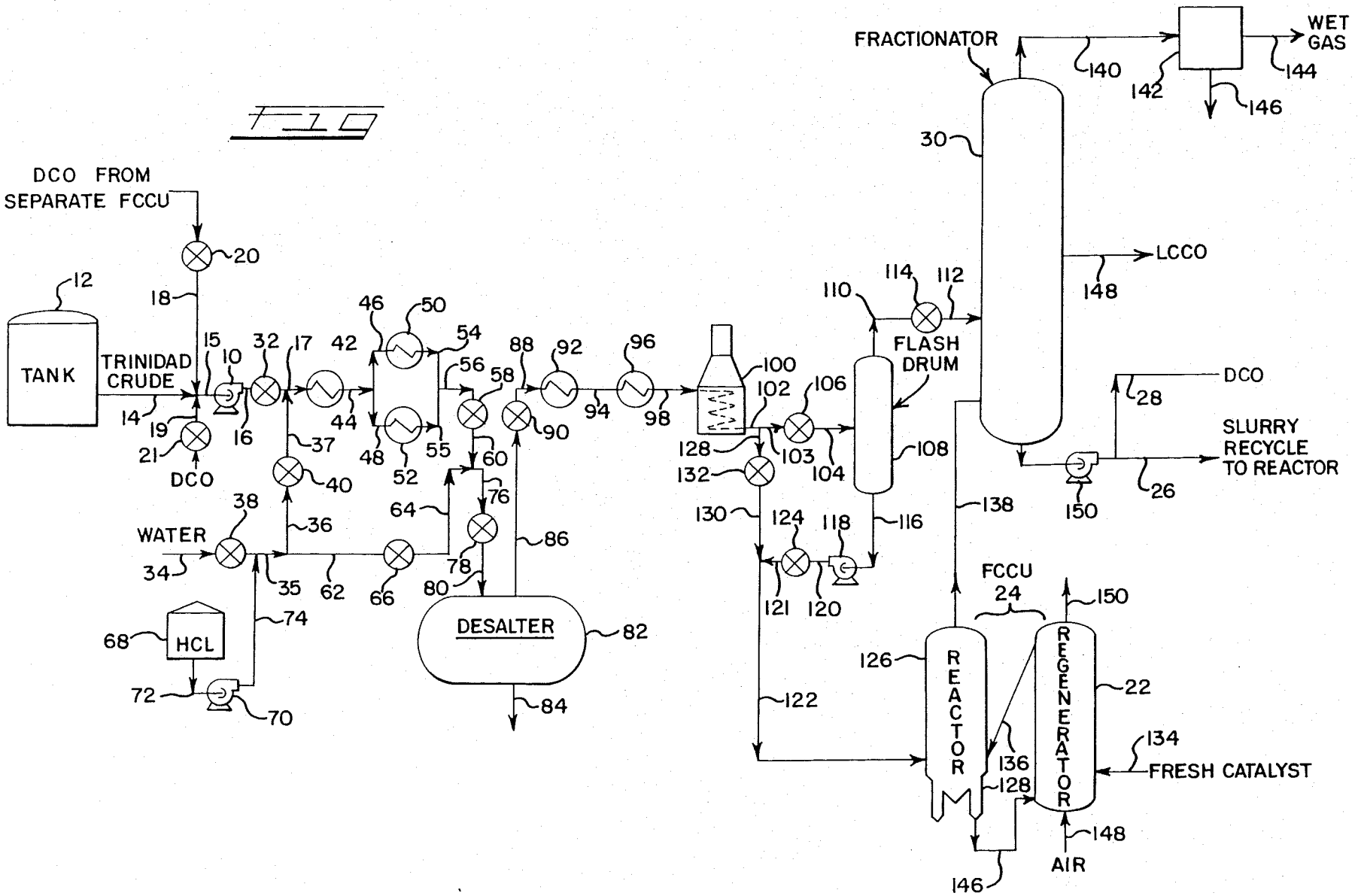

Unrefined, raw, whole crude oil or petroleum, is pumped by a pump 10 from tankage, such as an above ground storage tank 12 at about 75° F. to about 80° F., through pipelines 14–17. The whole crude oil comprises by volume: (a) less than about 35% hydrocarbons comprising naphtha and light hydrocarbons having a boiling temperature less than about 430° F., preferably less than 400° F.; (b) from about 20% to about 50% hydrocarbons comprising diesel oil and kerosene having a boiling temperature ranging from greater than about 430° F. to less than about 650° F.; (c) from about 20% to less than about 50% hydrocarbons comprising gas oil having a boiling temperature ranging from greater than about 650° F. to less than about 1000° F.; (d) less than about 20% hydrocarbons comprising resid having a boiling temperature greater than about 1000° F.; and (e) preferably less than 2% RAMS carbon by weight in the whole crude oil. Most preferably, a low resid crude is used with the RAMS carbon content of the resid ranging from about 0.5% to about 10% by weight. For best results, the preferred petroleum (whole crude oil) is Trinidad crude.

Decanted oil can be injected, fed, mixed, or blended with the whole crude oil in line 14 through decanted oil line 18 and/or 19, via valves 20 and 21, to raise the temperature of the regenerator 22 in the fluid catalytic cracking unit (FCCU) 24 so as to enhance the complete combustion of carbon monoxide in the regenerator 22. Decanted oil can be obtained from a separate FCCU or from the decanted oil ouput line 26 of the main fractionator 30, downstream of the subject FCCU 24. In some circumstances it may be desirable to inject, feed, mix, or blend, the decanted oil with the reactor charge or crude oil anywhere before reaching the reactor.

Valve 32 can be provided to regulate the flow of oil through line 17. Water can be passed through water lines 34–37 and injected, fed, and dispersed into oil line 17 downstream of valve 32. The flow rate of the water can be regulated or stopped by one or more water control valves 38 and 40.

The oil in line 17 is partially preheated to about 125° F. in a heat exchanger 42. The partially preheated oil from heat exchanger 42 in line 44 is passed through exchanger lines 46 and 48 to parallel heat exchangers 50 and 52 where the oil is further partially preheated to about 220° F. The partially preheated oil from heat exchangers 50 and 52 in exchanger effluent line 54–56 is passed through an oil flow valve 58 to line 60. Water from water lines 34 and 35 can be passed through water lines 62 and 64 via water flow valve 66 to be injected, fed, and dispersed into the oil in oil line 60. Hydrochloric acid or other acids from a tank 68 can be pumped by pH control pump 70 through acid lines 72 and 74 into the water in lines 35 and 62 to maintain and control the pH of the water injected into the oil. The oil and water in line 76 are mixed by a mix valve 78 and passed through mixed oil and water line 80 into a desalter 82. About 5% to about 10% water by volume can be added to the oil. In the desalter 82, the oil is desalted and the water removed. The removed water is discharged through water discharge line 84.

The desalted oil from the desalter 82 in line 86 is passed through line 88, via a valve 90, into a heat exchanger 92 where it is preheated to about 315° F. The preheated oil from heat exchanger 92 in exchanger effluent line 94 is passed into another heat exchanger 96 where it is further preheated to about 372° F. The preheated oil from heat exchanger 96 is passed from line 98 to a furnace 100 where it is heated to about 520° F. The heated oil from the furnace 100 is passed through oil lines 102–104, via heated oil flow valve 106, into a flash drum 108.

In the flash drum 108, the oil is flashed so a substantial portion of the naphtha and light ends (light hydrocarbons) having a boiling temperature below 430° F. are vaporized and removed through an overhead flash line 110. About 20% to about 30% by volume of Trinidad crude can be flashed. The flashed vapors in overhead flash line 110 are passed through a flash vapor line 112, via a valve 114, to the main fractionator 30.

The remaining flashed liquid oil (flashed bottoms) in the flash drum 108 is discharged from the bottom portion of the flash drum 108 through liquid line 116 and pumped by pump 118 through lines 120–122, via liquid flow control valve 124, into the catalytic cracking reactor 126 of the FCCU 24. The reactor charge (reactor feed) comprising flashed liquid oil (flashed) bottoms fed to the reactor 126 comprises by volume: (a) from about 0.1% to about 20% hydrocarbons comprising naphtha and light hydrocarbons having a boiling temperature less than about 430° F., preferably less than about 400° F.; (b) from about 20% to about 50% hydrocarbons comprising diesel oil and kerosene having a boiling temperature ranging from greater than about 430° F. to less than about 650° F.; (c) from about 30% to about 70%, preferably less than 50%, hydrocarbons comprising gas oil having a boiling temperature ranging from greater than about 650° F. to less than about 1000° F.; (d) less than about 20% hydrocarbons comprising resid having a boiling temperature greater than 1000° F.; and (e) preferably from about 0.5% to about 10% by weight RAMS carbon in the resid.

In some circumstances, it may be desirable to bypass the flash drum 108 and feed whole crude oil through bypass lines 128 and 130 and oil line 122, via bypass regulator valve 132 into the FCCU 24. Bypass valve 132 can be opened for bypass operations or can be closed if feed is flashed in the flash drum 108.

The fluid catalytic cracking unit (FCCU) 24 includes a catalytic cracking (FCC) reactor 126, a stripper section 128, and a regenerator 22. The catalytic cracking reactor 126 preferably comprises a riser reactor. In some circumstances it may be desirable to use a fluid bed reactor or a fluidized catalytic cracking reactor. Fresh replacement catalyst (makeup catalyst) is fed through fresh catalyst line 134 into the regenerator 22 at a replacement rate of about 0.25 to about 2.0, preferably less than about 0.5, pounds per barrel to reactor feed (flashed bottoms) to control the effects of contaminant metals in the reactor feed. In the catalytic cracking reactor 126, the oil is contacted, mixed, and fluidized with the fresh catalyst and regenerated catalyst from regenerated catalyst line 136 at catalytic cracking temperatures and pressures to catalytically crack and volatilize the oil feed into more valuable, lower molecular weight hydrocarbons. The temperatures in the reactor 126 can range from about 900° F. to about 1025° F. at a pressure from about 5 psig to about 50 psig. The circulation rate (weight hourly space velocity) of the cracking catalyst in the reactor can range from about 5 to about 200 WHSV. The velocity of the oil vapors in the riser reactor can range from about 5 ft/sec to about 100 ft/sec.

Suitable cracking catalysts include, but are not limited to, those containing silica and/or alumina, including the acidic type. The cracking catalyst may contain other refractory metal oxides such as magnesia or zirconia. Preferred cracking catalysts are those containing crystalline aluminosilicates, zeolites, or molecular sieves in an amount sufficient to materially increase the cracking activity of the catalyst, e.g., between about 1 and about 25% by weight. The crystalline aluminosilicates can have silica-to-alumina mole ratios of at least about 2:1, such as from about 2 to about 12:1. The crystalline aluminosilicates are usually available or made in sodium form and this component is preferably reduced, for instance, to less than about 4 or even less than about 1% by weight through exchange with hydrogen ions, hydrogen-precursors such as ammonium ions, or polyvalent metal ions. Suitable polyvalent metals include calcium, strontium, barium, and the rare earth metals such as cerium, lanthanum, neodymium, and/or naturally-occuring mixtures of the rare earth metals. Such crystalline materials are able to maintain their pore structure under the high temperature conditions of catalyst manufacture, hydrocarbon processing, and catalyst regeneration. The crystalline aluminosilicates often have a uniform pore structure of exceedingly small size with the cross-sectional diameter of the pores being in a size range of about 6 to about 20 angstroms, preferably about 10 to about 15 angstroms. Silica-alumina based cracking catalysts having a major proportion of silica, e.g., about 60 to about 90 weight percent silica and about 10 to about 40 weight percent alumina, are suitable for admixture with the crystalline aluminosilicate or for use as such as the cracking catalyst. Other cracking catalysts and pore sizes can be used. The cracking catalyst can also contain or comprise a carbon monoxide (CO) burning promoter or catalyst, such as a platinum catalyst to enhance the combustion of carbon monoxide in the dense phase in the regenerator 22.

The catalytically cracked hydrocarbon vapors (volitilized oil) from the catalytic cracking reactor 126 are passed through an overhead product line 138 into the FCC main fractionator 30. In the main fractionator 30, the oil vapors and flashed vapors are fractionated (separated) into: (a) light hydrocarbons having a boiling temperature less than about 430° F., (b) light catalytic cycle oil (LCCO), and decanted oil (DCO). The light hydrocarbons are withdrawn from the fractionator 30 through an overhead line 140 and fed to a separator drum 142. In the separator drum 142, the light hydrocarbons are separated into (1) wet gas and (2) $C_3$ to 430-° F. light hydrocarbon material comprising propane, propylene, butane, butylene, and naphtha. The wet gas is withdrawn from the separator drum 142 through a wet gas line 144 and further processed in a vapor recovery unit (VRU). The $C_3$ to 430-° F. material is withdrawn from the separator drum 142 through a line 146 and passed to the vapor recovery unit (VRU) for further processing. LCCO is withdrawn from the fractionator 30 through an LCCO line 148 for further refining, processing, or marketing. DCO is withdrawn from the fractionator 30 through one or more DCO lines 26 for further use. Slurry recycle comprising DCO can be pumped from the bottom portion of the fractionator 30 by pump 150 through a slurry line 26 for recycle to the reactor 126. The remainder of the DCO is conveyed through line 28 for further use in the refinery.

Spent deactivated (used) coked catalyst is discharged from the catalytic cracking reactor 126 and stripped of volatilizable hydrocarbons in the stripper section 128 with a stripping gas, such as with light hydrocarbon gases or steam. The stripped coked catalyst is passed from the stripper 128 through spent catalyst line 146 into the regenerator 22. Air is injected through air injector line 148 into the regenerator 22 at a rate of about 0.2 ft/sec to about 4 ft/sec. Preferably, excess air is injected in the regenerator 22 to completely convert the coke on the catalyst to carbon dioxide and steam. The excess air can be from about 2.5% to about 25% greater than the stoichiometric amount of air necessary for the complete conversion of coke to carbon dioxide and steam.

In the regenerator 22, the coke on catalyst is combusted in the presence of air so that the catalyst contains less than about 0.1% coke by weight. The coked catalyst is contained in the lower dense phase section of the regenerator 22, below an upper dilute phase section of the regenerator 22. Carbon monoxide can be combusted in both the dense phase and the dilute phase although combustion of carbon monoxide predominantly occurs in the dense phase with promoted burning, i.e., the use of a CO burning promoter. The temperature in the dense phase can range from about 1150° F. to about 1400° F. The temperature in dilute phase can range from about 1200° F. to about 1510° F. The stack gas (combustion gases) exiting the regenerator 22 through overhead flue line 150 preferably contains less than about 0.2% CO by volume (2000 ppm). The major portion of the heat of combustion of carbon monoxide is preferably absorbed by the catalyst and transferred with the regenerated catalyst through a regenerated catalyst line 136 into the catalytic cracking reactor 126.

In a catalytic cracker (reactor) 126, some non-volatile carbonaceous material, or coke, is deposited on the catalyst particles. Coke comprises highly condensed aromatic hydrocarbons which generally contain 4–10 wt. % hydrogen. As coke builds up on the catalyst, the activity of the catalyst for cracking and the selectivity of the catalyst for producing gasoline blending stock diminish. The catalyst particles can recover a major proportion of their original capabilities by removal of most of the coke from the catalyst by a suitable regeneration process.

Catalyst regeneration is accomplished by burning the coke deposits from the catalyst surface with an oxygen-containing gas such as air. The burning of coke deposits from the catalyst requires a large volume of oxygen or air. Oxidation of coke may be characterized in a simplified manner as the oxidation of carbon and may be represented by the following chemical equations:

a. $C+O_2 \rightarrow CO_2$ b. $2C+O_2 \rightarrow 2CO$ c. $2CO+O_2 \rightarrow 2CO_2$ Reactions (a) and (b) both occur at typical catalyst regeneration conditions wherein the catalyst temperature may range from about 1050° F. to about 1300° F. and are exemplary of gas-solid chemical interactions when regenerating catalyst at temperatures within this range. The effect of any increase in temperature is reflected in an increased rate of combustion of carbon and a more complete removal of carbon, or coke, from the catalyst particles. As the increased rate of combustion is accompanied by an increased evolution of heat whenever sufficient oxygen is present, the gas phase reaction (c) may occur. This latter reaction is initiated and propagated by free radicals. Further combustion of CO to $CO_2$ is an attractive source of heat energy because reaction (c) is highly exothermic.

EXAMPLES

The following examples serve to give specific illustration of the practice of this invention but are not intended in any way to limit the scope of this invention.

Whole crude oil consisting of Trinidad crude was fed, processed, and refined in a catalyst cracking process and system substantially similar to the process flow diagram of the Figure. Specifically, 51 days of test runs were conducted starting on Mar. 29, 1987 at FCCU No. 2 at the Amoco Oil Company Refinery at Texas City, Texas. The test runs produced unexpected surprisingly good results, since it was heretofore believed that Trinidad crude could not be catalytically cracked without prior fractionation of the Trinidad crude or similar light crude in a pipestill(s), vacuum tower, and/or atmospheric tower. The extent, amount, and quality of the products produced by the test runs were unexpected. Furthermore, the test runs later became a commercial success when the products produced during the tests runs were eventually sold for about a $5 million net profit. Such profit was mainly attributable to the unique process arrangement and sequence shown in the Figure and recited in the claims.

EXAMPLE 1

Totals for the test runs were as follows:

| Feed | Volume BSD | °API | Lb/Hr | Wt. % |
|---|---|---|---|---|
| Trinidad | 31,800 | 32.3 | 400,345 | 98.5 |
| FCCU No. 3 DCO | 370 | −3.3 | 6,015 | 1.5 |
| | Total 32,170 | | Total 406,360 | |

| Products | Volume BSD | °API | Use |
|---|---|---|---|
| Absorber Offgas | 220 MSCFH | 22.6 MW | fuel |
| Propane-Propylene | 5 MSCFH | 42.7 MW | fuel |
| Propane-Propylene | 2,600 | 144.5 | alkylation feed |
| Butane-Butylene | 3,910 | 109.5 | alkylation feed |
| Light Catalytic Naphtha | 4,020 | 76.6 | blending |
| Heavy Catalytic Naphtha | 12,810 | 49.3 | reformer feed |
| Light Catalytic Cycle Oil (LCCO) | 10,190 | 26.4 | fuel oil |
| Decanted Oil (DCO) | 280 | −1.1 | recycle, fuel |
| Coke | | | |

| Products | Lb/Hr | Wt % | Use |
|---|---|---|---|
| Absorber Offgas | 13,230 | 3.26 | fuel |
| Propane-Propylene | 540 | 0.13 | fuel |
| Propane-Propylene | 19,370 | 4.77 | alkylation feed |
| Butane-Butylene | 33,450 | 8.23 | alkylation feed |
| Light Catalytic Naphtha | 39,830 | 9.80 | blending |
| Heavy Catalytic Naphtha | 146,070 | 35.95 | reformer feed |
| Light Catalytic Cycle Oil (LCCO) | 133,050 | 32.74 | fuel oil |
| Decanted Oil (DCO) | 4,440 | 1.09 | recycle, fuel |
| Coke | 16,380 | 4.03 | |
| Total | 406,360 | 100.00 | |

EXAMPLE 2

During the test runs on Apr. 13, 1987, the Trinidad whole crude had: an actual API gravity of 32.7°, a molecular weight of 231.98, an observed refractive index of 1.4612, and an average boiling point of 571.4° F. The Trinidad crude comprised by weight: 0.22% RAMS carbon, 0.25% sulfur, and 0.0230 total nitrogen. The Trinidad whole crude had the following characteristics at a normal pressure of 760 mm.

| True Boiling Point °F. | % Crude Vaporized (Boiled) |
|---|---|
| 400 | 24.73 |
| 430 | 28.78 |
| 450 | 31.96 |
| 475 | 36.43 |
| 500 | 40.85 |
| 525 | 45.08 |
| 550 | 49.32 |
| 575 | 53.44 |
| 600 | 57.54 |
| 625 | 61.27 |
| 650 | 64.43 |
| 675 | 67.59 |
| 700 | 70.65 |
| 725 | 73.37 |
| 750 | 76.09 |
| 800 | 81.01 |
| 850 | 84.60 |
| 900 | 88.20 |
| 950 | 91.00 |
| 1000 | 93.00 |
| 1100 | 96.32 |
| 1200 | 98.95 |

EXAMPLE 3

During the test runs on Apr. 13, 1987, the flashed bottoms which were fed to the catalytic cracker had: an actual API gravity of 29°, a molecular weight of 290.94, an observed refractive index of 1.4702, and an average boiling point of 678.2° F. The flashed bottoms comprised by weight: 0.35% RAMS carbon, 0.37% sulfur, 0.0370 total nitrogen. The flashed bottoms had the following characteristics at a normal pressure of 760 mm.

| True Boiling Point °F. | % Flashed Bottoms Vaporized (Boiled) |
|---|---|
| 400 | 11.36 |
| 430 | 15.06 |
| 450 | 17.53 |
| 475 | 20.68 |
| 500 | 24.11 |
| 525 | 27.53 |
| 550 | 31.40 |
| 575 | 36.40 |
| 600 | 41.27 |
| 625 | 45.82 |
| 650 | 50.34 |
| 675 | 54.58 |

-continued

| True Boiling Point °F. | % Flashed Bottoms Vaporized (Boiled) |
|---|---|
| 700 | 58.81 |
| 725 | 62.50 |
| 750 | 65.97 |
| 800 | 72.36 |
| 850 | 77.98 |
| 900 | 81.95 |
| 950 | 85.00 |
| 1000 | 88.05 |
| 1100 | 95.21 |
| 1200 | 98.63 |

EXAMPLE 4

During the test runs on Apr. 15, 1987, the Trinidad whole crude had: an actual API gravity of 33°, a molecular weight of 224, and an average boiling point of 571.63° F. The Trinidad crude had the following characteristics at a normal pressure of 760 mm.

| True Boiling Point °F. | % Crude Vaporized (Boiled) |
|---|---|
| 400 | 18.38 |
| 430 | 21.80 |
| 450 | 24.62 |
| 475 | 28.14 |
| 500 | 32.21 |
| 525 | 36.88 |
| 550 | 41.55 |
| 575 | 46.23 |
| 600 | 50.81 |
| 625 | 55.04 |
| 650 | 59.27 |
| 675 | 63.50 |
| 700 | 67.73 |
| 725 | 72.30 |
| 750 | 77.28 |
| 800 | 84.81 |
| 850 | 90.65 |
| 900 | 93.64 |
| 950 | 95.70 |
| 1000 | 96.98 |
| 1100 | 99.54 |
| 1200 | 100.00 |

EXAMPLE 5

During the test runs on Apr. 15, 1987, the flash drum bottoms (flashed bottoms) which were fed to the FCCU had: an actual API gravity of 29.3°, a molecular weight of 265, and an average boiling point of 685.59° F. The flashed bottoms comprised by weight: 0.3% RAMS carbon and 0.25% total nitrogen. The flashed bottoms had the following characteristics at a normal pressure of 760 mm.

| True Boiling Point °F. | % Flashed Bottoms Vaporized (Boiled) |
|---|---|
| 400 | 8.69 |
| 430 | 9.46 |
| 450 | 9.96 |
| 475 | 13.36 |
| 500 | 16.91 |
| 525 | 20.69 |
| 550 | 26.01 |
| 575 | 31.25 |
| 600 | 36.25 |
| 625 | 41.24 |
| 650 | 46.23 |
| 675 | 50.99 |
| 700 | 55.06 |
| 725 | 59.13 |
| 750 | 63.20 |
| 800 | 71.30 |
| 850 | 79.27 |
| 900 | 84.83 |
| 950 | 90.34 |
| 1000 | 98.47 |
| 1100 | 100.00 |
| 1200 | 100.00 |

EXAMPLE 6

During the test runs on Apr. 28, 1987, the Trinidad whole crude had an API gravity of 32.9° and a RAMS carbon content of 0.31% by weight. The initial boiling point was 143° F. The whole crude had the following characteristics:

| True Boiling Point °F. | % Crude Vaporized (Boiled) |
|---|---|
| 335 | 10 |
| 420 | 20 |
| 485 | 30 |
| 531 | 40 |
| 578 | 50 |
| 629 | 60 |
| 684 | 70 |
| 699 | 75.5 |

EXAMPLE 7

During the test runs from Mar. 29, 1987 to May 18, 1987, 1.62 MM barrels of Trinidad crude were processed at a throughput rate of 31.8 MBCD. The catalytic cracking reactor charge rate averaged 23.8 MBCD, and 24.6% flashed off and processed with a riser. The volume recovery was 105.78%, and the weight balance was 99.3%. Gasoline production was 16.7 MBCD. Light catalytic naphtha production was 23.8%. Heavy catalytic naphtha production was 76.2%.

EXAMPLES 8–357

The feed rates, products, and other data taken for the tests run from Mar. 30, 1987 to May 19, 1987 were as follows:

| Date 1987 | Fresh Feed B/D | Propane Propylene to-Fuel SCFH | Propane Propylene B/D | Butane Butylene FR-313 | Lt Cat Gasoline B/D |
|---|---|---|---|---|---|
| 0330 | 25947 | 6.7 | 2895 | 3010 | 6158 |
| 0331 | 29560 | 0.0 | 2538 | 3475 | 5074 |
| 0401 | 29338 | 6.2 | 2255 | 3331 | 4749 |
| 0402 | 29448 | 0.0 | 2617 | 3196 | 4828 |
| 0403 | 29900 | 0.0 | 2467 | 3675 | 4150 |

-continued

| | | | | | |
|---|---|---|---|---|---|
| 0404 | 29524 | 4.0 | 2282 | 3632 | 3622 |
| 0405 | 29570 | 0.5 | 2454 | 3706 | 3600 |
| 0406 | 28989 | 0.0 | 2363 | 4046 | 3630 |
| 0407 | 29378 | 0.0 | 2562 | 3658 | 4280 |
| 0408 | 34000 | 0.0 | 2432 | 4315 | 5098 |
| 0409 | 33378 | 0.4 | 2525 | 4127 | 4600 |
| 0410 | 33308 | 0.0 | 2707 | 3687 | 5391 |
| 0411 | 32405 | 1.4 | 2672 | 3588 | 5457 |
| 0412 | 32733 | 4.1 | 2660 | 4851 | 5123 |
| 0413 | 33361 | 10.3 | 2638 | 3754 | 5100 |
| 0414 | 33454 | 19.3 | 2663 | 3901 | 5154 |
| 0415 | 33034 | 9.5 | 2702 | 3984 | 5043 |
| 0416 | 32146 | 6.8 | 2690 | 4124 | 3638 |
| 0417 | 32004 | 4.5 | 2579 | 3868 | 3234 |
| 0418 | 31780 | 4.8 | 2263 | 3919 | 2650 |
| 0419 | 32404 | 0.7 | 2643 | 3729 | 2623 |
| 0420 | 32043 | 0.0 | 2724 | 4000 | 3466 |
| 0421 | 32930 | 0.0 | 2559 | 4372 | 4031 |
| 0422 | 32910 | 3.8 | 2565 | 4164 | 4746 |
| 0423 | 33243 | 0.0 | 2708 | 3843 | 4433 |
| 0424 | 33425 | 0.1 | 2828 | 3889 | 3216 |
| 0425 | 31915 | 0.3 | 2512 | 4319 | 2901 |
| 0426 | 29173 | 0.6 | 2314 | 4822 | 2288 |
| 0427 | 33780 | 0.6 | 2800 | 4528 | 2784 |
| 0428 | 33860 | 0.5 | 2873 | 3878 | 3691 |
| 0429 | 34522 | 0.4 | 2817 | 3945 | 3679 |
| 0430 | 33453 | 0.9 | 2487 | 4366 | 3527 |
| 0501 | 33365 | 1.1 | 2637 | 4304 | 3984 |
| 0502 | 33290 | 3.4 | 2776 | 4245 | 4932 |
| 0503 | 32936 | 0.0 | 2574 | 4228 | 5052 |
| 0504 | 32990 | 0.5 | 2764 | 3784 | 5280 |
| 0505 | 32964 | 1.9 | 3076 | 3581 | 5473 |
| 0506 | 33181 | 2.7 | 2751 | 3669 | 4751 |
| 0507 | 32930 | 4.7 | 2727 | 4006 | 4039 |
| 0508 | 33459 | 0.1 | 2494 | 4255 | 2999 |
| 0509 | 33232 | 0.0 | 2497 | 4287 | 2365 |
| 0510 | 33959 | 0.2 | 3130 | 3301 | 2629 |
| 0511 | 17116 | 45.7 | 1353 | 3434 | 1829 |
| 0512 | 27848 | 10.4 | 1940 | 3209 | 3400 |
| 0513 | 32513 | 0.0 | 2555 | 3782 | 2960 |
| 0514 | 32691 | 0.3 | 2691 | 4167 | 2950 |
| 0515 | 32650 | 0.1 | 2817 | 4071 | 3035 |
| 0516 | 33122 | 6.7 | 3032 | 3700 | 2530 |
| 0517 | 32932 | 11.0 | 2815 | 3633 | 3126 |
| 0518 | 33500 | 11.2 | 2529 | 3610 | 4942 |
| 0519 | 30158 | 19.7 | 2324 | 3888 | 5150 |
| Average | 31799 | 4.0 | 2594 | 3899 | 3988 |

| Date 1987 | Heavy Cat Gasoline B/D | HCCO B/D | LCCO B/D | DCO Recycle B/D | DCO from another FCCU B/D | Reactor Charge B/D |
|---|---|---|---|---|---|---|
| 0330 | 7209 | 98 | 7502 | 0 | 125 | 15000 |
| 0331 | 10950 | 0 | 8667 | 0 | 300 | 24000 |
| 0401 | 11300 | 0 | 9009 | 0 | 335 | 22000 |
| 0402 | 11290 | 0 | 9193 | 0 | 0 | 22000 |
| 0403 | 12012 | 0 | 8910 | 0 | 0 | 22500 |
| 0404 | 12365 | 0 | 8500 | 0 | 0 | 22500 |
| 0405 | 12299 | 0 | 8661 | 0 | 0 | 22500 |
| 0406 | 11776 | 0 | 8342 | 0 | 0 | 22500 |
| 0407 | 11342 | 0 | 8999 | 0 | 0 | 22000 |
| 0408 | 12780 | 0 | 10400 | 0 | 0 | 22000 |
| 0409 | 12710 | 0 | 10500 | 0 | 0 | 25000 |
| 0410 | 12078 | 0 | 11231 | 0 | 420 | 25200 |
| 0411 | 11777 | 0 | 10631 | 316 | 400 | 25000 |
| 0412 | 11274 | 0 | 10851 | 245 | 500 | 24500 |
| 0413 | 12207 | 0 | 11330 | 288 | 730 | 24790 |
| 0414 | 12100 | 0 | 11466 | 439 | 745 | 25000 |
| 0415 | 11872 | 0 | 11091 | 401 | 685 | 24340 |
| 0416 | 12512 | 0 | 11267 | 338 | 700 | 23710 |
| 0417 | 12780 | 0 | 11203 | 261 | 685 | 24340 |
| 0418 | 12893 | 0 | 11659 | 227 | 440 | 24000 |
| 0419 | 13728 | 0 | 11264 | 343 | 480 | 24200 |
| 0420 | 13195 | 0 | 10646 | 311 | 546 | 24000 |
| 0421 | 12777 | 0 | 10666 | 405 | 760 | 25500 |
| 0422 | 12688 | 0 | 10739 | 304 | 700 | 25500 |
| 0423 | 12928 | 0 | 10920 | 185 | 642 | 25400 |
| 0424 | 13950 | 0 | 11503 | 160 | 597 | 25000 |
| 0425 | 13218 | 0 | 10512 | 301 | 100 | 25310 |
| 0426 | 12010 | 0 | 9550 | 275 | 100 | 26100 |
| 0427 | 13707 | 0 | 11928 | 482 | 538 | 25500 |

-continued

| | | | | | | |
|---|---|---|---|---|---|---|
| 0428 | 13996 | 0 | 11083 | 338 | 530 | 25350 |
| 0429 | 14302 | 0 | 11311 | 375 | 514 | 25450 |
| 0430 | 13879 | 0 | 10817 | 262 | 300 | 25500 |
| 0501 | 13434 | 0 | 10399 | 319 | 395 | 25000 |
| 0502 | 12499 | 65 | 9931 | 418 | 376 | 24670 |
| 0503 | 12470 | 0 | 10136 | 311 | 421 | 25000 |
| 0504 | 12608 | 10 | 10171 | 308 | 343 | 25000 |
| 0505 | 12577 | 61 | 10385 | 199 | 198 | 25200 |
| 0506 | 13092 | 0 | 10295 | 150 | 412 | 25222 |
| 0507 | 13744 | 169 | 10353 | 156 | 597 | 25300 |
| 0508 | 14364 | 0 | 10768 | 294 | 600 | 25220 |
| 0509 | 15356 | 0 | 10615 | 263 | 590 | 25250 |
| 0510 | 15795 | 0 | 10902 | 386 | 193 | 8417 |
| 0511 | 9163 | 615 | 5109 | 696 | 667 | 14320 |
| 0512 | 11036 | 437 | 9326 | 393 | 1000 | 24790 |
| 0513 | 14991 | 0 | 10427 | 345 | 60 | 24970 |
| 0514 | 14638 | 6 | 9648 | 266 | 505 | 24830 |
| 0515 | 14748 | 0 | 9921 | 86 | 180 | 24550 |
| 0516 | 15640 | 0 | 10090 | 343 | 20 | 24170 |
| 0517 | 14432 | 0 | 10268 | 338 | 28 | 24500 |
| 0518 | 13079 | 0 | 10787 | 412 | 409 | 24520 |
| 0519 | 10780 | 0 | 9442 | 268 | 219 | 24500 |
| Average | 12752 | 29 | 10183 | 239 | 374.2 | 23747 |

| Date 1987 | Regen Flue Gas CO ppm AR-2 | Regen Flue Gas O2 vol % AR-1 | Reactor Feed deg F II-1-31 | Regen Temp deg F II-1-12 | Feed Preheat deg F II-1-45 |
|---|---|---|---|---|---|
| 0330 | 613 | 0.6 | 541 | 1251 | 414 |
| 0331 | 491 | 4.3 | 523 | 1257 | 375 |
| 0401 | 296 | 5.1 | 532 | 1246 | 391 |
| 0402 | 250 | 5.0 | | | |
| 0403 | 250 | 5.0 | | | |
| 0404 | 238 | 5.0 | 531 | 1249 | 390 |
| 0405 | 282 | 5.0 | 531 | 1243 | 395 |
| 0406 | 264 | 4.9 | 523 | 1245 | 395 |
| 0407 | 283 | 4.2 | 525 | 1251 | 392 |
| 0408 | 520 | 2.6 | 525 | 1253 | 385 |
| 0409 | 754 | 1.0 | 520 | 1259 | 386 |
| 0410 | 724 | 2.2 | 520 | 1264 | 388 |
| 0411 | 597 | 3.1 | 522 | 1258 | 380 |
| 0412 | 696 | 2.1 | 524 | 1266 | 381 |
| 0413 | 708 | 2.1 | 523 | 1266 | 384 |
| 0414 | 582 | 2.2 | 519 | 1272 | 386 |
| 0415 | 445 | 2.7 | 515 | 1278 | 382 |
| 0416 | 498 | 1.6 | 515 | 1279 | 384 |
| 0417 | 554 | 1.4 | 515 | 1281 | 387 |
| 0418 | 485 | 1.5 | 513 | 1291 | 391 |
| 0419 | 439 | 2.0 | 511 | 1285 | 388 |
| 0420 | 497 | 1.8 | 513 | 1286 | 388 |
| 0421 | 485 | 1.6 | 513 | 1290 | 381 |
| 0422 | 369 | 2.0 | 515 | 1290 | 376 |
| 0423 | 252 | 2.5 | 517 | 1293 | 378 |
| 0424 | 221 | 3.0 | 514 | 1291 | 378 |
| 0425 | 263 | 2.8 | 517 | 1292 | 383 |
| 0426 | 644 | 1.3 | 525 | 1282 | 402 |
| 0427 | 443 | 2.1 | 524 | 1292 | 380 |
| 0428 | 476 | 2.1 | 522 | 1283 | 367 |
| 0429 | 396 | 2.5 | 521 | 1284 | 364 |
| 0430 | 460 | 2.2 | 515 | 1283 | 368 |
| 0501 | 526 | 3.0 | 512 | 1274 | 364 |
| 0502 | 648 | 2.3 | 516 | 1264 | 359 |
| 0503 | 682 | 1.5 | 516 | 1267 | 358 |
| 0504 | 660 | 1.7 | 515 | 1266 | 356 |
| 0505 | 787 | 2.9 | 517 | 1268 | 358 |
| 0506 | 751 | 2.7 | 518 | 1259 | 357 |
| 0507 | 516 | 3.5 | 513 | 1275 | 369 |
| 0508 | 310 | 4.5 | 516 | 1273 | 368 |
| 0509 | 315 | 4.3 | 517 | 1276 | 367 |
| 0510 | 274 | 4.9 | 521 | 1277 | 364 |
| 0511 | 260 | 5.1 | 498 | 1185 | 388 |
| 0512 | 142 | 5.2 | 549 | 1298 | 403 |
| 0513 | 351 | 2.8 | 524 | 1307 | 384 |
| 0514 | 331 | 4.2 | 520 | 1285 | 368 |
| 0515 | 332 | 5.0 | 520 | 1286 | 367 |
| 0516 | 374 | 4.7 | 530 | 1283 | 367 |
| 0517 | 475 | 4.6 | 530 | 1272 | 364 |
| 0518 | 629 | 3.7 | 527 | 1276 | 370 |
| 0519 | 558 | 1.5 | 550 | 1276 | 406 |
| Average | 459 | 3.06 | 521 | 1272 | 379 |

-continued

| Date 1987 | Fresh Feed Deg API | DCO Deg API | HCCO Deg API | LCCO Deg API | Hvy Cat Gasoline Deg API | LCN Deg API |
|---|---|---|---|---|---|---|
| 0330 | 31.8 | −1.5 | 14.4 | 28.3 | 47 | 74.7 |
| 0331 | 32.3 | 1.2 | 14.4 | 27.7 | 47 | 74.7 |
| 0401 | 31.6 | 1.3 | 24.4 | 27.2 | 50.4 | 73.3 |
| 0402 | 31.6 | 1.3 | 24.4 | 27.2 | 50.4 | 73.3 |
| 0403 | 31.6 | 1.3 | 24.4 | 27.2 | 50.4 | 73.3 |
| 0402 | 32.8 | 2.4 | 24.4 | 26.7 | 50.4 | 73.3 |
| 0405 | 33 | 2.2 | 24.4 | 26.6 | 50.4 | 73.3 |
| 0406 | 32.6 | 0.4 | 24.4 | 24.6 | 49.7 | 74.4 |
| 0407 | 33.1 | 1.1 | 24.4 | 27.3 | 49.7 | 74.4 |
| 0408 | 33.1 | 1.1 | 24.4 | 27.3 | 49.7 | 74.4 |
| 0409 | 32.5 | 1.9 | 24.4 | 27.2 | 49.3 | 76.4 |
| 0410 | 32.6 | −0.5 | 24.4 | 27.2 | 49.3 | 76.4 |
| 0411 | 32.9 | −1 | 24.4 | 25.7 | 49.3 | 76.4 |
| 0412 | 32.7 | −3.5 | 24.4 | 26.5 | 49.3 | 76.4 |
| 0413 | 33.1 | −0.8 | 24.4 | 25.2 | 48.2 | 75.7 |
| 0414 | 32.3 | −3 | 24.4 | 25.2 | 48.2 | 75.7 |
| 0415 | 32.8 | −1.3 | 24.4 | 26.6 | 46.7 | 73.4 |
| 0416 | 27.6 | −2.2 | 24.4 | 27.2 | 46.7 | 73.4 |
| 0417 | 32.8 | −1.9 | 24.4 | 26.5 | 46.7 | 73.4 |
| 0418 | 32.9 | −4.3 | 24.4 | 26.9 | 46.7 | 73.4 |
| 0419 | 31.6 | −0.3 | 24.4 | 26.4 | 46.7 | 73.4 |
| 0420 | 34.2 | −0.2 | 24.4 | 27.5 | 46.7 | 73.4 |
| 0421 | 32.5 | −2.3 | 24.4 | 27.6 | 54.2 | 73.4 |
| 0422 | 32.1 | −1.4 | 11.4 | 26.1 | 48.6 | 75.4 |
| 0423 | 32.6 | −3.9 | 11.4 | 25.9 | 48.6 | 77.1 |
| 0424 | 32.7 | −2.7 | 11.4 | 26.4 | 48.6 | 77.1 |
| 0425 | 30.7 | 1 | 11.4 | 26.4 | 48.6 | 77.1 |
| 0426 | 30.5 | −6.3 | 11.4 | 23.1 | 48.6 | 77.1 |
| 0427 | 33 | −4.1 | 11.4 | 24.2 | 50.6 | 71.4 |
| 0428 | 33.7 | 1.2 | 11.4 | 28 | 50.6 | 71.4 |
| 0492 | 33.4 | −1.8 | 9.4 | 26 | 50.9 | 79.4 |
| 0430 | 32.9 | 1 | 9.4 | 26.3 | 50.9 | 79.4 |
| 0501 | 32.8 | −0.8 | 9.4 | 27.1 | 50.9 | 79.4 |
| 0502 | 32 | 0.8 | 9.4 | 27 | 50.9 | 79.4 |
| 0503 | 34.8 | 1.1 | 9.4 | 27 | 50.9 | 79.4 |
| 0504 | 34 | 0 | 9.4 | 26.8 | 47.3 | 75.2 |
| 0505 | 32.9 | −1.8 | 9.4 | 26.5 | 47.3 | 75.2 |
| 0506 | 32.7 | 0 | 9.4 | 26.5 | 48 | 76.7 |
| 0507 | 32.9 | −3.7 | 9.4 | 27.1 | 48 | 76.7 |
| 0508 | 32.7 | −2.9 | 9.4 | 26.2 | 48 | 76.7 |
| 0509 | 32.9 | −3.9 | 9.4 | 25.1 | 48 | 76.7 |
| 0510 | 33.4 | 0.4 | 9.4 | 25.8 | 48 | 76.7 |
| 0511 | 32 | −0.2 | 9.4 | 27.6 | 47.2 | 83.8 |
| 0512 | 27.4 | −1.8 | 9.4 | 27.6 | 47.2 | 83.8 |
| 0513 | 32.3 | −1.6 | 18.2 | 25.6 | 51.7 | 87.1 |
| 0514 | 32.9 | −4.7 | 18.2 | 25.7 | 51.7 | 87.1 |
| 0515 | 33 | −4.2 | 18.2 | 24.6 | 51.7 | 87.1 |
| 0516 | 32.8 | −2.8 | 18.2 | 25.8 | 51.7 | 85 |
| 0517 | 32.8 | −2.8 | 18.2 | 25.8 | 51.7 | 85 |
| 0518 | 32.8 | −2.8 | 18.2 | 25.8 | 51.7 | 78.8 |
| 0519 | 36.4 | 0.5 | 18.2 | 26.8 | 51.7 | 78.8 |
| Average | 32.3 | −1.1 | 17.3 | 26.4 | 49.3 | 76.9 |

| Date | LCCO | LCCO | Heavy Catalytic Naphtha | | Light Catalytic Naphtha |
|---|---|---|---|---|---|
| 1987 | 90% | FBP | 90% | FBP | RVP |
| 0330 | 513 | 562 | 344 | 413 | 18.6 |
| 0331 | 554 | 624 | 342 | 398 | 17.6 |
| 0401 | 561 | 616 | 340 | 402 | 15.3 |
| 0402 | 572 | 624 | 345 | 396 | 12.8 |
| 0403 | 592 | 652 | 352 | 392 | 15.9 |
| 0404 | 583 | 642 | 350 | 388 | 15.9 |
| 0405 | 570 | 633 | 329 | 371 | 15.9 |
| 0406 | 574 | 630 | 340 | 415 | 12.9 |
| 0407 | 579 | 632 | 349 | 409 | 13.3 |
| 0408 | 592 | 637 | 343 | 383 | 13.8 |
| 0409 | 590 | 635 | 344 | 375 | 15.1 |
| 0410 | 630 | 668 | 340 | 406 | 13 |
| 0411 | 604 | 670 | 356 | 400 | 13.1 |
| 0412 | 596 | 664 | 336 | 404 | 11.9 |
| 0413 | 600 | 654 | 341 | 381 | 15.3 |
| 0414 | 676 | 673 | 350 | 400 | 12.3 |
| 0415 | 592 | 654 | 342 | 386 | 15.3 |
| 0416 | 627 | 695 | 331 | 367 | 12 |
| 0417 | 596 | 662 | 338 | 374 | 13.5 |
| 0418 | 600 | 664 | 339 | 367 | 15.7 |
| 0419 | 575 | 633 | 352 | 389 | 15.9 |
| 0420 | 643 | 690 | 350 | 389 | 15.9 |

-continued

| | | | | | |
|---|---|---|---|---|---|
| 0421 | 576 | 639 | 347 | 387 | 11.2 |
| 0422 | 598 | 665 | 347 | 388 | 10.8 |
| 0423 | 600 | 673 | 349 | 395 | 13.4 |
| 0424 | 655 | 672 | 343 | 380 | 15.6 |
| 0425 | 607 | 636 | 352 | 420 | 15.6 |
| 0426 | 632 | 688 | 342 | 395 | 16.1 |
| 0427 | 603 | 682 | 326 | 384 | 13.7 |
| 0428 | 591 | 643 | 347 | 406 | 13.7 |
| 0429 | 618 | 676 | 361 | 472 | 13.1 |
| 0430 | 607 | 676 | 347 | 379 | 12.6 |
| 0501 | 595 | 652 | 338 | 395 | 12.3 |
| 0502 | 576 | 626 | 339 | 375 | 11.9 |
| 0503 | 595 | 650 | 339 | 399 | 11.1 |
| 0504 | 590 | 640 | 348 | 402 | 11.8 |
| 0505 | 598 | 660 | 348 | 410 | |
| 0506 | 601 | 667 | 355 | 382 | 12 |
| 0507 | 587 | 648 | 340 | 382 | 15 |
| 0508 | 619 | 676 | 345 | 389 | 14.5 |
| 0509 | 630 | 682 | 344 | 397 | 16 |
| 0510 | 610 | 667 | 348 | 385 | 16.4 |
| 0511 | 397 | 652 | 341 | 381 | 16.3 |
| 0512 | | | | | |
| 0513 | 613 | 676 | 341 | 411 | 21.4 |
| 0514 | 601 | 696 | 331 | 360 | 20.7 |
| 0515 | 616 | 682 | 340 | 411 | 20.7 |
| 0516 | 609 | 665 | 349 | 376 | 20.7 |
| 0517 | 660 | 704 | 370 | 440 | 10.7 |
| 0518 | 587 | 646 | 352 | 411 | 14.9 |
| 0519 | 603 | 663 | 376 | 420 | 20.6 |
| Average | 596 | 656 | 345 | 395 | 14.8 |

| Date 1987 | Feed Sulfur wt % | Feed RAMS wt % | LCCO Flash °F. | DCO Sulfur wt % | Naphtha in LCCO vol % |
|---|---|---|---|---|---|
| 0330 | 0.3 | 0.13 | 152 | | 13.14 |
| 0331 | 0.29 | 0.13 | 158 | 1.37 | 18.47 |
| 0401 | 0.33 | 0.26 | 158 | 1.38 | 18.88 |
| 0402 | 0.28 | | 168 | | 13.93 |
| 0403 | | | | | 18.98 |
| 0404 | 0.31 | 0.26 | 153 | 1.38 | 14 |
| 0405 | 0.32 | 0.31 | 153 | 1.22 | 17.75 |
| 0406 | 0.31 | 0.31 | 160 | 1.22 | 16.87 |
| 0407 | 0.3 | 0.31 | 157 | 1.22 | 17.36 |
| 0408 | 0.27 | 0.35 | | | 13.31 |
| 0409 | 0.27 | 0.35 | 171 | 1.16 | 20.69 |
| 0410 | 0.27 | 0.35 | 171 | 1.16 | 17.74 |
| 0411 | 0.58 | 0.35 | 164 | 1.16 | 16.94 |
| 0412 | 0.58 | 0.35 | 161 | 1.25 | 18.62 |
| 0413 | 0.28 | 0.35 | 165 | 1.25 | 19 |
| 0414 | 0.3 | 0.35 | 166 | 1.25 | 19.43 |
| 0415 | 0.25 | 0.21 | 161 | 1.17 | 24.11 |
| 0416 | 0.25 | 0.21 | 141 | 1.17 | 17.21 |
| 0417 | 0.26 | 0.21 | 156 | 1.17 | 21.04 |
| 0418 | 0.28 | 0.21 | 154 | 1.17 | 22.66 |
| 0419 | 0.28 | 0.33 | 157 | 1.35 | 24.42 |
| 0420 | 0.29 | 0.33 | 165 | 1.35 | 17.9 |
| 0421 | 0.27 | 0.33 | 166 | 1.35 | 21.54 |
| 0422 | 0.26 | 0.23 | 166 | 1.27 | 21.52 |
| 0423 | 0.29 | 0.23 | 160 | 1.27 | 23.8 |
| 0424 | 0.29 | 0.23 | 156 | 1.27 | 19.66 |
| 0425 | 0.3 | 0.23 | 154 | 1.27 | 12.07 |
| 0426 | 0.37 | 0.25 | 166 | 1.27 | 16.97 |
| 0427 | 0.29 | 0.25 | 158 | 1.27 | 21.71 |
| 0428 | 0.29 | 0.25 | 156 | 1.27 | 18.64 |
| 0429 | 0.29 | 0.25 | 160 | 1.27 | 16.75 |
| 0430 | 0.22 | 0.25 | 158 | 1.27 | 21.94 |
| 0501 | 0.25 | 0.25 | 154 | 1.27 | 18.08 |
| 0502 | 0.27 | 0.25 | 157 | 1.27 | 17.13 |
| 0503 | 0.25 | 0.3 | 151 | 1.35 | 21.26 |
| 0504 | 0.22 | 0.3 | 157 | 1.35 | 20.76 |
| 0505 | | | | | 18.16 |
| 0506 | | | | | 16.87 |
| 0507 | | | | | 19.75 |
| 0508 | | | | | 18.8 |
| 0509 | | | | | 18.8 |
| 0510 | | | | | 16.3 |
| 0511 | | | | | 21.44 |
| 0512 | | | | | 20.84 |
| 0513 | 0.28 | 0.26 | | | 19.87 |
| 0514 | | | | | 19.87 |
| 0515 | 0.28 | | 162 | 1.32 | 19.41 |
| 0516 | 0.29 | | 151 | 1.32 | 17.94 |

-continued

| | | | | | |
|---|---|---|---|---|---|
| 0517 | 0.28 | | 138 | 1.27 | 19.22 |
| 0518 | 0.35 | | 138 | 1.27 | 19 |
| 0519 | 0.34 | | 156 | 1.27 | 18.7 |
| Average | 0.30 | 0.27 | 158 | 1.27 | . |

| Date | Propane-Propylene to Fuel | | | Butane-Butylene | |
|---|---|---|---|---|---|
| 1987 | Wt % | Vol % | Wt % | Vol % | Wt % |
| 0330 | 0.23 | 11.16 | 6.45 | 11.60 | 7.91 |
| 0331 | 0.00 | 8.59 | 4.98 | 11.76 | 8.04 |
| 0401 | 0.18 | 7.68 | 4.44 | 11.35 | 7.73 |
| 0402 | 0.00 | 8.89 | 5.33 | 10.85 | 8.60 |
| 0403 | 0.00 | 8.25 | 4.95 | 12.29 | 9.74 |
| 0404 | 0.12 | 7.73 | 4.70 | 12.30 | 8.45 |
| 0405 | 0.02 | 8.30 | 4.90 | 12.53 | 8.67 |
| 0406 | 0.00 | 8.15 | 4.80 | 13.96 | 9.63 |
| 0407 | 0.0 | 8.72 | 5.15 | 12.45 | 8.63 |
| 0408 | 0.00 | 7.15 | 4.22 | 12.69 | 8.79 |
| 0409 | 0.01 | 7.56 | 4.45 | 12.37 | 8.55 |
| 0410 | 0.00 | 8.13 | 4.71 | 11.07 | 7.55 |
| 0411 | 0.04 | 8.25 | 4.79 | 11.07 | 7.56 |
| 0412 | 0.11 | 8.13 | 4.73 | 14.82 | 10.15 |
| 0413 | 0.27 | 7.91 | 4.58 | 11.25 | 7.67 |
| 0414 | 0.50 | 7.96 | 4.58 | 11.66 | 7.90 |
| 0415 | 0.25 | 8.18 | 4.81 | 12.06 | 8.12 |
| 0416 | 0.18 | 8.37 | 4.76 | 12.83 | 8.36 |
| 0417 | 0.12 | 8.06 | 4.74 | 12.09 | 8.13 |
| 0418 | 0.13 | 7.12 | 4.23 | 12.33 | 8.38 |
| 0419 | 0.02 | 8.16 | 4.70 | 11.51 | 7.78 |
| 0420 | 0.00 | 8.50 | 4.96 | 12.48 | 8.55 |
| 0421 | 0.00 | 7.77 | 4.45 | 13.28 | 8.93 |
| 0422 | 0.10 | 7.80 | 4.55 | 12.65 | 8.48 |
| 0423 | 0.00 | 8.14 | 4.78 | 11.56 | 7.79 |
| 0424 | 0.00 | 8.46 | 4.98 | 11.64 | 7.86 |
| 0425 | 0.01 | 7.87 | 4.53 | 13.53 | 9.20 |
| 0426 | 0.02 | 7.93 | 4.56 | 16.53 | 11.23 |
| 0427 | 0.02 | 8.29 | 4.76 | 13.40 | 9.10 |
| 0428 | 0.01 | 8.49 | 4.90 | 11.45 | 7.82 |
| 0429 | 0.01 | 8.16 | 4.86 | 11.43 | 7.76 |
| 0430 | 0.03 | 7.43 | 4.45 | 13.05 | 8.91 |
| 0501 | 0.03 | 7.90 | 4.55 | 12.90 | 8.74 |
| 0502 | 0.09 | 8.34 | 4.78 | 12.75 | 8.61 |
| 0503 | 0.00 | 7.81 | 4.54 | 12.84 | 8.81 |
| 0504 | 0.01 | 8.38 | 4.86 | 11.47 | 7.86 |
| 0505 | 0.05 | 9.33 | 5.41 | 10.86 | 7.44 |
| 0506 | 0.07 | 8.29 | 4.86 | 11.06 | 7.51 |
| 0507 | 0.13 | 8.28 | 4.82 | 12.16 | 8.21 |
| 0508 | 0.00 | 7.45 | 4.34 | 12.72 | 8.58 |
| 0509 | 0.00 | 7.51 | 4.37 | 12.90 | 8.71 |
| 0510 | 0.00 | 9.22 | 5.61 | 9.72 | 4.11 |
| 0511 | 2.35 | 7.90 | 4.58 | 20.06 | 8.07 |
| 0512 | 0.32 | 6.97 | 3.94 | 11.52 | 4.53 |
| 0513 | 0.00 | 7.86 | 4.32 | 11.63 | 7.45 |
| 0514 | 0.01 | 8.23 | 4.76 | 12.75 | 8.57 |
| 0515 | 0.00 | 8.63 | 5.05 | 12.47 | 8.50 |
| 0516 | 0.18 | 9.15 | 5.39 | 11.17 | 7.65 |
| 0517 | 0.30 | 8.55 | 5.03 | 11.03 | 7.55 |
| 0518 | 0.29 | 7.55 | 4.34 | 10.78 | 7.30 |
| 0519 | 0.58 | 7.70 | 4.56 | 12.89 | 8.98 |

| Date | Lt Cat Gasoline | | Hvy Cat Gasoline | |
|---|---|---|---|---|
| 1987 | Vol % | Wt % | Vol % | Wt % |
| 0330 | 23.73 | 18.80 | 27.78 | 25.42 |
| 0331 | 17.17 | 13.64 | 37.04 | 33.99 |
| 0401 | 16.19 | 12.9 | 38.52 | 34.5 |
| 0402 | 16.40 | 13.1 | 38.34 | 34.4 |
| 0403 | 13.88 | 11.1 | 40.17 | 36.0 |
| 0404 | 12.27 | 9.8 | 41.8 | 37.8 |
| 0405 | 12.17 | 9.8 | 41.59 | 37.6 |
| 0406 | 12.52 | 10.0 | 40.62 | 36.8 |
| 0407 | 14.57 | 11.6 | 38.61 | 35.1 |
| 0408 | 14.99 | 12.0 | 37.59 | 34.1 |
| 0409 | 13.78 | 10.9 | 38.08 | 34.5 |
| 0410 | 16.18 | 12.6 | 36.26 | 32.4 |
| 0411 | 16.84 | 13.1 | 36.34 | 32.5 |
| 0412 | 15.65 | 12.1 | 34.44 | 30.7 |
| 0413 | 15.29 | 11.8 | 36.59 | 32.6 |
| 0414 | 15.41 | 11.8 | 36.17 | 32.1 |
| 0415 | 15.27 | 11.9 | 35.94 | 32.3 |
| 0416 | 11.32 | 8.6 | 38.92 | 33.8 |
| 0417 | 10.10 | 7.9 | 39.93 | 35.8 |

-continued

| | | | | |
|---|---|---|---|---|
| 0418 | 8.34 | 6.6 | 40.57 | 36.8 |
| 0419 | 8.10 | 6.3 | 42.37 | 38.1 |
| 0420 | 10.82 | 8.6 | 41.18 | 37.5 |
| 0421 | 12.24 | 9.5 | 38.80 | 33.3 |
| 0422 | 14.42 | 11.1 | 38.55 | 34.1 |
| 0423 | 13.33 | 10.2 | 38.89 | 34.6 |
| 0424 | 9.62 | 7.4 | 41.74 | 37.2 |
| 0425 | 9.09 | 7.0 | 41.42 | 37.2 |
| 0426 | 7.84 | 6.1 | 41.17 | 36.9 |
| 0427 | 8.24 | 6.5 | 40.58 | 35.9 |
| 0428 | 10.90 | 8.7 | 41.33 | 36.8 |
| 0429 | 10.66 | 8.2 | 41.43 | 36.8 |
| 0430 | 10.54 | 8.1 | 41.49 | 37.0 |
| 0501 | 11.94 | 9.2 | 40.26 | 35.7 |
| 0502 | 14.81 | 11.3 | 37.55 | 33.2 |
| 0503 | 15.34 | 11.9 | 37.86 | 34.0 |
| 0504 | 16.01 | 12.6 | 38.22 | 34.9 |
| 0505 | 16.60 | 13.1 | 38.15 | 34.8 |
| 0506 | 14.32 | 11.1 | 39.46 | 35.5 |
| 0507 | 12.26 | 9.5 | 41.74 | 37.4 |
| 0508 | 8.96 | 6.9 | 42.93 | 38.4 |
| 0509 | 7.12 | 5.5 | 46.21 | 41.4 |
| 0510 | 7.74 | 6.1 | 46.51 | 42.4 |
| 0511 | 10.68 | 7.7 | 53.53 | 46.7 |
| 0512 | 12.21 | 8.6 | 39.63 | 33.8 |
| 0513 | 9.11 | 6.4 | 46.11 | 38.6 |
| 0514 | 9.02 | 6.7 | 44.78 | 39.4 |
| 0515 | 9.30 | 6.9 | 45.17 | 40.3 |
| 0516 | 7.64 | 5.8 | 47.22 | 42.3 |
| 0517 | 9.49 | 7.2 | 43.82 | 39.3 |
| 0518 | 14.75 | 11.3 | 39.04 | 34.5 |
| 0519 | 17.08 | 13.5 | 35.75 | 32.5 |

| Date | LCCO | LCCO | HCCO | HCCO | Decanted Oil | |
|---|---|---|---|---|---|---|
| 1987 | Vol % | Wt % | Vol % | Wt % | Vol % | Wt % |
| 0330 | 28.91 | 29.55 | 0.38 | 0.42 | 0.00 | 0.00 |
| 0331 | 29.32 | 30.17 | 0.00 | 0.00 | 0.00 | 0.00 |
| 0401 | 30.71 | 31.6 | 0.00 | 0.00 | 0.00 | 0.00 |
| 0402 | 31.22 | 32.1 | 0.00 | 0.00 | 0.00 | 0.00 |
| 0403 | 29.80 | 30.6 | 0.00 | 0.00 | 0.00 | 0.00 |
| 0404 | 28.79 | 29.9 | 0.00 | 0.00 | 0.00 | 0.00 |
| 0405 | 29.29 | 30.5 | 0.00 | 0.00 | 0.00 | 0.00 |
| 0406 | 28.78 | 30.3 | 0.00 | 0.00 | 0.00 | 0.00 |
| 0407 | 30.63 | 31.8 | 0.00 | 0.00 | 0.00 | 0.00 |
| 0408 | 30.59 | 31.7 | 0.00 | 0.00 | 0.00 | 0.00 |
| 0409 | 31.46 | 32.5 | 0.00 | 0.00 | 0.00 | 0.00 |
| 0410 | 33.72 | 34.3 | 0.00 | 0.00 | 0.00 | 0.00 |
| 0411 | 32.81 | 33.8 | 0.00 | 0.00 | 0.97 | 1.21 |
| 0412 | 33.15 | 33.8 | 0.00 | 0.00 | 0.75 | 0.94 |
| 0413 | 33.96 | 34.7 | 0.00 | 0.00 | 0.86 | 1.06 |
| 0414 | 34.27 | 34.8 | 0.00 | 0.00 | 1.31 | 1.63 |
| 0415 | 33.57 | 34.0 | 0.00 | 0.00 | 1.21 | 1.49 |
| 0416 | 35.05 | 34.2 | 0.00 | 0.00 | 1.05 | 1.26 |
| 0417 | 35.00 | 35.4 | 0.00 | 0.00 | 0.82 | 1.01 |
| 0418 | 36.69 | 37.4 | 0.00 | 0.00 | 0.72 | 0.91 |
| 0419 | 34.76 | 35.3 | 0.00 | 0.00 | 1.06 | 1.29 |
| 0420 | 33.22 | 33.9 | 0.00 | 0.00 | 0.97 | 1.20 |
| 0421 | 32.39 | 32.4 | 0.00 | 0.00 | 1.23 | 1.52 |
| 0422 | 32.63 | 33.0 | 0.00 | 0.00 | 0.92 | 1.13 |
| 0423 | 32.85 | 33.4 | 0.00 | 0.00 | 0.56 | 0.70 |
| 0424 | 34.41 | 35.0 | 0.00 | 0.00 | 0.48 | 0.60 |
| 0425 | 32.94 | 33.7 | 0.00 | 0.00 | 0.94 | 1.15 |
| 0426 | 32.74 | 34.2 | 0.00 | 0.00 | 0.94 | 1.21 |
| 0427 | 35.31 | 36.6 | 0.00 | 0.00 | 1.43 | 1.81 |
| 0428 | 32.73 | 33.3 | 0.00 | 0.00 | 1.00 | 1.22 |
| 0429 | 32.76 | 33.7 | 0.00 | 0.00 | 1.09 | 1.36 |
| 0430 | 32.33 | 33.3 | 0.00 | 0.00 | 0.78 | 0.96 |
| 0501 | 31.17 | 31.8 | 0.00 | 0.00 | 0.96 | 1.19 |
| 0502 | 29.83 | 30.4 | 0.19 | 0.22 | 1.25 | 1.53 |
| 0503 | 30.77 | 31.8 | 0.00 | 0.00 | 0.94 | 1.16 |
| 0504 | 30.83 | 31.8 | 0.03 | 0.04 | 0.93 | 1.16 |
| 0505 | 31.50 | 32.5 | 0.18 | 0.21 | 0.60 | 0.76 |
| 0506 | 31.03 | 31.8 | 0.00 | 0.00 | 0.45 | 0.55 |
| 0507 | 31.44 | 31.8 | 0.51 | 0.59 | 0.47 | 0.60 |
| 0508 | 32.18 | 32.8 | 0.00 | 0.00 | 0.88 | 1.10 |
| 0509 | 31.94 | 32.8 | 0.00 | 0.00 | 0.79 | 1.00 |
| 0510 | 32.10 | 33.4 | 0.00 | 0.00 | 1.14 | 1.41 |
| 0511 | 29.85 | 29.3 | 3.60 | 3.98 | 4.07 | 4.83 |
| 0512 | 33.49 | 32.0 | 1.57 | 1.69 | 1.41 | 1.66 |
| 0513 | 32.07 | 31.3 | 0.00 | 0.00 | 1.06 | 1.25 |
| 0514 | 29.51 | 30.3 | 0.02 | 0.02 | 0.81 | 1.03 |
| 0515 | 30.39 | 31.8 | 0.0 | 0.00 | 0.26 | 0.34 |

-continued

| | | | | | | |
|---|---|---|---|---|---|---|
| 0516 | 30.46 | 31.8 | 0.00 | 0.00 | 1.04 | 1.32 |
| 0517 | 31.18 | 32.5 | 0.00 | 0.00 | 1.03 | 1.31 |
| 0518 | 32.20 | 33.1 | 0.00 | 0.00 | 1.23 | 1.55 |
| 0519 | 31.31 | 32.9 | 0.00 | 0.00 | 0.89 | 1.12 |

| Date 1987 | Regen Total Air SCFH | Coke Burn lb/hr | Coke Wt % |
|---|---|---|---|
| 0330 | 3273640 | 16832 | 5.14 |
| 0331 | 3285700 | 13996 | 3.76 |
| 0401 | 3256780 | 13168 | 3.55 |
| 0402 | 3188480 | 12995 | 3.49 |
| 0403 | 3201780 | 13049 | 3.45 |
| 0404 | 3156080 | 12855 | 3.47 |
| 0405 | 3160880 | 12861 | 3.47 |
| 0406 | 3147740 | 12919 | 3.55 |
| 0407 | 3148440 | 13443 | 3.65 |
| 0408 | 3221640 | 15030 | 3.53 |
| 0409 | 3185420 | 16096 | 3.83 |
| 0410 | 3243520 | 15444 | 3.63 |
| 0411 | 3236900 | 14734 | 3.57 |
| 0412 | 3250500 | 15556 | 3.71 |
| 0413 | 3261240 | 15603 | 3.63 |
| 0414 | 3274580 | 15573 | 3.60 |
| 0415 | 3276320 | 15240 | 3.58 |
| 0416 | 3210660 | 15729 | 3.68 |
| 0417 | 3338440 | 16579 | 4.02 |
| 0418 | 3228340 | 15906 | 3.92 |
| 0419 | 3308900 | 15959 | 3.82 |
| 0420 | 3311200 | 16134 | 3.96 |
| 0421 | 3425760 | 16798 | 3.94 |
| 0422 | 3235520 | 15571 | 3.66 |
| 0423 | 3456740 | 16191 | 3.78 |
| 0424 | 3414380 | 15620 | 3.64 |
| 0425 | 3425300 | 15846 | 3.89 |
| 0426 | 3062300 | 15271 | 4.09 |
| 0427 | 3309740 | 15830 | 3.66 |
| 0428 | 3358260 | 16066 | 3.73 |
| 0429 | 3381200 | 15824 | 3.60 |
| 0430 | 3429500 | 16333 | 3.85 |
| 0501 | 3395280 | 17120 | 4.03 |
| 0502 | 3325800 | 17320 | 4.07 |
| 0503 | 3296800 | 17884 | 4.31 |
| 0504 | 3292020 | 17710 | 4.25 |
| 0505 | 3308060 | 16722 | 4.01 |
| 0506 | 3356300 | 17123 | 4.05 |
| 0507 | 3513240 | 17172 | 4.06 |
| 0508 | 3491840 | 16147 | 3.76 |
| 0509 | 3476840 | 16254 | 3.81 |
| 0510 | 3102360 | 13978 | 3.27 |
| 0511 | 3206520 | 14272 | 6.30 |
| 0512 | 3308320 | 14653 | 3.88 |
| 0513 | 3160660 | 16027 | 3.67 |
| 0514 | 3406840 | 15977 | 3.82 |
| 0515 | 3278620 | 14710 | 3.57 |
| 0516 | 3261480 | 14886 | 3.58 |
| 0517 | 3286340 | 15150 | 3.66 |
| 0518 | 3236680 | 15697 | 3.68 |
| 0519 | 3245480 | 17648 | 4.72 |

| Date | Total Gasoline | Converted Barrels | Total Products | | | |
|---|---|---|---|---|---|---|
| 1987 | B/D | B/D | B/D | lb/hr | vol % | wt % |
| 0330 | 13367 | 17128 | 26872 | 320013 | 103.6 | 97.7 |
| 0331 | 16024 | 20139 | 30704 | 362631 | 103.9 | 97.4 |
| 0401 | 16049 | 19594 | 30643 | 362142 | 104.4 | 97.6 |
| 0402 | 16118 | 18898 | 31124 | 369966 | 105.7 | 99.4 |
| 0403 | 16162 | 20275 | 31214 | 372781 | 104.4 | 98.6 |
| 0404 | 15987 | 19778 | 30400 | 360207 | 103.0 | 97.2 |
| 0405 | 15899 | 20072 | 30720 | 361991 | 103.9 | 97.6 |
| 0406 | 15406 | 19743 | 30157 | 356165 | 104.0 | 97.8 |
| 0407 | 15622 | 19462 | 30841 | 363068 | 105.0 | 98.6 |
| 0408 | 17878 | 21979 | 35025 | 411669 | 103.0 | 96.6 |
| 0409 | 17310 | 22275 | 34462 | 408789 | 103.2 | 97.4 |
| 0410 | 17469 | 20990 | 35093 | 416222 | 105.4 | 97.9 |
| 0411 | 17234 | 20211 | 34441 | 409904 | 106.3 | 99.3 |
| 0412 | 16397 | 20632 | 35005 | 417006 | 106.9 | 99.5 |
| 0413 | 17307 | 20741 | 35316 | 426958 | 105.9 | 99.4 |
| 0414 | 17254 | 20551 | 35723 | 432944 | 106.8 | 100.0 |
| 0415 | 16915 | 21276 | 35094 | 421607 | 106.2 | 99.1 |
| 0416 | 16150 | 19258 | 34568 | 416605 | 107.5 | 97.4 |
| 0417 | 16014 | 19861 | 33925 | 411527 | 106.0 | 99.7 |
| 0418 | 15543 | 19454 | 33611 | 411071 | 105.8 | 101.3 |

-continued

| | | | | | | |
|---|---|---|---|---|---|---|
| 0419 | 16351 | 20596 | 34330 | 416807 | 105.9 | 99.9 |
| 0420 | 16661 | 19975 | 34341 | 413336 | 107.2 | 101.5 |
| 0421 | 16808 | 21232 | 34809 | 413253 | 105.7 | 97.0 |
| 0422 | 17434 | 21267 | 35207 | 425925 | 107.0 | 100.0 |
| 0423 | 17361 | 21902 | 35016 | 426571 | 105.3 | 99.6 |
| 0424 | 17166 | 20890 | 35546 | 431039 | 106.3 | 100.4 |
| 0425 | 16119 | 19189 | 33763 | 409443 | 105.8 | 100.5 |
| 0426 | 14298 | 18233 | 31259 | 384769 | 107.2 | 103.1 |
| 0427 | 16491 | 20686 | 36229 | 443603 | 107.2 | 102.6 |
| 0428 | 17687 | 21386 | 35860 | 431825 | 105.9 | 100.2 |
| 0429 | 17981 | 21466 | 36430 | 439814 | 105.5 | 100.0 |
| 0430 | 17406 | 21846 | 35337 | 426705 | 105.6 | 100.6 |
| 0501 | 17418 | 21581 | 35077 | 419518 | 105.1 | 98.7 |
| 0502 | 17431 | 21673 | 34866 | 414844 | 104.7 | 97.4 |
| 0503 | 17522 | 21880 | 34770 | 415321 | 105.6 | 100.1 |
| 0504 | 17888 | 21820 | 34926 | 420638 | 105.9 | 101.0 |
| 0505 | 18050 | 21286 | 35352 | 424052 | 107.2 | 101.8 |
| 0506 | 17843 | 21570 | 34707 | 418308 | 104.6 | 98.8 |
| 0507 | 17783 | 24149 | 35193 | 425006 | 106.9 | 100.5 |
| 0508 | 17363 | 21409 | 35174 | 426911 | 105.1 | 99.3 |
| 0509 | 17721 | 21389 | 35382 | 431540 | 106.5 | 101.2 |
| 0510 | 18424 | 21278 | 36143 | 426546 | 106.4 | 99.7 |
| 0511 | 10992 | | 22281 | 267006 | | |
| 0512 | 14436 | 16898 | 29785 | 354140 | 107.0 | 93.9 |
| 0513 | 17951 | 20913 | 35061 | 421863 | 107.8 | 96.6 |
| 0514 | 17588 | 22021 | 34365 | 410009 | 105.1 | 98.0 |
| 0515 | 17783 | 21874 | 34678 | 411592 | 106.2 | 99.8 |
| 0516 | 18170 | 21624 | 35335 | 420672 | 106.7 | 101.1 |
| 0517 | 17558 | 21423 | 34611 | 413877 | 105.1 | 100.0 |
| 0518 | 18021 | 21300 | 35359 | 423672 | 105.5 | 99.2 |
| 0519 | 15930 | 19566 | 31851 | 384495 | 105.6 | 102.8 |
| Average | 16740 | 20638 | 33686 | 404046 | 105.7 | 99.3 |

| Date 1987 | Conv vol % | Through-put Ratio (TPR) | Energy Index MBTU/bbl |
|---|---|---|---|
| 0330 | 66.0 | 1.14 | 362 |
| 0331 | 68.1 | 1.12 | 303 |
| 0401 | 66.8 | 1.10 | 289 |
| 0402 | 64.2 | 1.10 | 281 |
| 0403 | 67.8 | 1.09 | 277 |
| 0404 | 67.0 | 1.10 | 281 |
| 0405 | 67.9 | 1.08 | 277 |
| 0406 | 68.1 | 1.09 | 281 |
| 0407 | 66.2 | 1.09 | 287 |
| 0408 | 64.6 | 1.08 | 272 |
| 0409 | 66.7 | 1.11 | 290 |
| 0410 | 63.0 | 1.09 | 284 |
| 0411 | 62.4 | 1.06 | 282 |
| 0412 | 63.0 | 1.07 | 284 |
| 0413 | 62.2 | 1.06 | 280 |
| 0414 | 61.4 | 1.06 | 283 |
| 0415 | 64.4 | 1.06 | 284 |
| 0416 | 59.9 | 1.06 | 292 |
| 0417 | 62.1 | 1.07 | 301 |
| 0418 | 61.2 | 1.08 | 294 |
| 0419 | 63.6 | 1.08 | 293 |
| 0420 | 62.3 | 1.08 | 299 |
| 0421 | 64.5 | 1.08 | 300 |
| 0422 | 64.6 | 1.07 | 289 |
| 0423 | 65.9 | 1.06 | 295 |
| 0424 | 62.5 | 1.06 | 287 |
| 0425 | 60.1 | 1.07 | 301 |
| 0426 | 62.5 | 1.06 | 316 |
| 0427 | 61.2 | 1.0 | 286 |
| 0428 | 63.2 | 1.07 | 289 |
| 0429 | 62.2 | 1.06 | 281 |
| 0430 | 65.3 | 1.07 | 289 |
| 0501 | 64.7 | 1.06 | 302 |
| 0502 | 65.1 | 1.11 | 304 |
| 0503 | 66.4 | 1.07 | 314 |
| 0504 | 66.1 | 1.13 | 313 |
| 0505 | 64.6 | 1.09 | 302 |
| 0506 | 65.0 | 1.07 | 312 |
| 0507 | 65.0 | 1.07 | 312 |
| 0508 | 64.0 | 1.06 | 300 |
| 0509 | 64.4 | 1.06 | 298 |
| 0510 | 62.7 | 1.07 | 272 |
| 0511 | | 1.07 | 545 |
| 0512 | 60.7 | 1.12 | 313 |
| 0513 | 64.3 | 1.08 | 296 |

-continued

| | | | |
|---|---|---|---|
| 0514 | 67.4 | 1.04 | 297 |
| 0515 | 67.0 | 1.05 | 281 |
| 0516 | 65.3 | 1.06 | 281 |
| 0517 | 65.1 | 1.04 | 287 |
| 0518 | 63.6 | 1.07 | 290 |
| 0519 | 64.9 | 1.08 | 342 |
| Average | 64.3 | 1.08 | 299 |

Among the many advantages of the novel catalytic cracking process are:

1. Outstanding ability to refine petroleum and produce gasoline without the use of a pipestill(s), atmospheric tower, and/or vacuum tower.
2. Superior processing of whole crude oil.
3. Excellent production of gasoline and other hydrocarbons.
4. Enhanced catalytic cracking of petroleum.
5. Good throughput.
6. Cost effective.
7. Convenient.
8. Safe.
9. Efficient.
10. Effective.

Although embodiments of the invention have been shown and described, it is to be understood that various modifications, additions, and substitutions, as well as rearrangements of process steps, can be made by those skilled in the art without departing from the novel spirit and scope of this invention.

What is claimed is:

1. A catalyst cracking process, comprising the steps of:

substantially desalting petroleum comprising crude oil;

flashing and separating said desalted crude oil in a flash drum into a flashed overhead stream and a flashed bottom stream;

feeding said flashed bottom stream to a catalytic cracking unit comprising a regenerator and at least one catalytic cracking reactor selected from the group consisting of a riser reactor and a fluidized bed reactor, in the absence of previously fractionating said petroleum in a fractionator selected from the group consisting of a pipestill, crude unit, an atmospheric tower, and a vacuum tower;

substantially cracking said flashed bottom stream in said catalytic cracking reactor in the presence of a cracking catalyst to form a cracked effluent stream;

passing said cracked effluent stream from said catalytic cracking reactor and said flashed overhead stream from said flash drum in a fractionator;

fractionating said cracked effluent stream from said catalytic cracking reactor and said flashed overhead stream from said flash drum in said fractionator;

regenerating said catalyst in a regenerator; and recycling said regenerated catalyst to said catalytic cracking reactor.

2. A catalytic cracking process in accordance with claim 1 wherein said petroleum contains less than 50% gas oil by volume.

3. A catalytic cracking process in accordance with claim 1 wherein said petroleum comprises whole crude oil.

4. A catalytic cracking process in accordance with claim 1 including substantially combusting carbon monoxide in said regenerator during said regeneration.

5. A catalytic cracking process in accordance with claim 4 wherein catalyst includes a promoter for enhancing said combustion of carbon monoxide in said regenerator.

6. A catalytic cracking process, comprising the steps of:

flashing and separating substantially desalted petroleum into an overhead flashed stream and flashed bottoms;

substantially cracking said flashed bottoms comprising a reactor charge in a catalytic cracking reactor in the presence of a cracking catalytic to produce cracked effluent comprising more valuable, lower molecular weight hydrocarbons;

said reactor charge comprising by volume from about 0.1% to about 20% hydrocarbons comprising naphtha and light hydrocarbons having a boiling temperature less than about 430° F., from about 20% to about 50% hydrocarbons comprising diesel oil and kerosene having a boiling temperature ranging from greater than about 430° F. to less than about 650° F., from about 20% to less than about 50% hydrocarbons comprising gas oil having a boiling temperature ranging from greater than about 650° F. to less than about 1000° F. and less than about 20% hydrocarbons comprising resid having a boiling temperature greater than about 1000° F.;

passing and fractionating said cracked effluent and said overhead flashed stream in a fractionator;

regenerating said catalyst in a regenerator; and conveying said regenerated catalyst to said reactor.

7. A catalytic cracking process in accordance with claim 6 wherein said resid has a RAMS carbon content ranging from about 0.5% to about 10% by weight.

8. A catalyst cracking process, comprising:

pumping whole crude oil from a storage tank through a series of heat exchangers;

said whole crude oil comprising by volume less than about 35% naphtha and lighter hydrocarbons having a boiling temperature less than about 430° F., from about 20% to about 50% diesel oil and kerosene having a boiling temperature ranging from more than about 430° F. to less than about 650° F., from about 20% to less than about 50% gas oil having a boiling temperarture ranging from more than about 650° F. to less than about 1000° F., from about 0.1% to less than about 20% resid having a boiling temperature more than about 1000° F. and a RAMS carbon content from about 0.5% to about 10% by weight;

injecting water into said whole crude oil;

mixing said whole crude oil and said water;

substantially desalting said whole crude oil;
heating salt desalted crude oil in a furnace;
passing said heated crude oil to a flash drum;
substantially flashing, separating and removing a substantial portion of said naphtha and light hydrocarbons from said whole crude oil in said flash drum leaving flashed crude oil liquid comprising reactor charge;
passing said removed naphtha and light hydrocarbons to a fractionator;
pumping said flashed crude oil liquid to a fluid catalytic cracking unit comprising a regenerator and a catalytic cracking reactor selected from the group consisting of a riser reactor and a fluidized bed reactor;
substantially catalytically cracking and volatilizing said flashed crude oil liquid in said catalytic cracking reactor in the presence of a cracking catalyst to produce mor valuable, lower molecular weight hydrocarbons leaving substantially deactivated, coked catalyst;
stripping volatile hydrocarbons from said coked catalyst;
feeding said stripped coked catalyst to said regenerator;
injecting a sufficient amount of air into said regenerator to fluidize said catalyst in said regenerator;
regenerating and substantially combusting said coked catalyst in said regenerator to produce regenerated cracking catalyst containing less than about 0.1% coke by weight;
feeding and recycling said regenerated cracking catalyst to said catalytic cracking reactor;
passing said cracked volatilized crude oil from said catalytic cracking reactor to a fractionator;
fractionating and separating said cracked volatilized crude oil from said catalytic cracking reactor and said flash naphtha and said light hydrocarbons from said flash drum in said fractionator to produce a stream of light hydrocarbons, a stream of light catalytic cycle oil, and at least one stream of decanted oil;
conveying said light hydrocarbons from said fractionator to a separator drum; and
separating said light hydrocarbons in said separator drum to produce a stream of wet gas and a stream of material comprising propane, propylene, butane, butylene, and naphtha.

9. A catalyst cracking process in accordance with claim 8 including injecting decanted oil into whole crude oil before said whole crude oil enters said reactor.

10. A catalytic cracking process in accordance with claim 9 wherein at least some of said decanted oil from said stream of decanted oil is injected into said reactor charge.

11. A catalytic cracking process in accordance with claim 8 wherein excess air is injected into said regenerator to substantially completely convert said combusted coke to carbon dioxide and steam.

12. A catalytic cracking process in accordance with claim 11 wherein said catalyst comprises a promoter for enhancing the complete combustion of carbon monoxide in said regenerator.

13. A catalyst cracking process in accordance with claim 8 wherein said whole crude oil contains less than about 2% RAMS carbon by weight.

14. A catalytic cracking process in accordance with claim 8 wherein said whole crude oil comprises at least one oil selected from the group consisting of Trinidad crude, Brass River crude, HIPS crude, Florence Canal crude, St. Gabriel crude, and Louisiana Light crude.

15. A catalytic cracking process in accordance with claim 14 wherein said catalytic cracking reactor comprises a riser reactor.

16. A catalytic cracking process in accordance with claim 15 wherein said fresh catalyst is fed to said regenerator at a replacement rate of at least about 0.25 pounds of catalyst per barrel of reactor charge.

17. A catalyst cracking process in accordance with claim 16 wherein said fresh catalyst is fed to said regenerator at a replacement rate greater than about 0.25 to less than about 2.0 pounds per barrel of reactor charge to substantially control the effects of contaminant metals in said reactor charge.

* * * * *

UNITED STATES PATENT AND TRADEMARK OFFICE

CERTIFICATE OF CORRECTION

PATENT NO. : 4,859,310

DATED : August 22, 1989

INVENTOR(S) : William D. Fitzharris, et al

It is certified that error appears in the above-identified patent and that said Letters Patent is hereby corrected as shown below:

| Col. | Line | |
|---|---|---|
| 1 | 12 | "catalytic" should read --catalyst--. |
| 1 | 34 | "tower and" should read --tower are--. |
| 3 | 60 | "line" should read --lines--. |
| 5 | 49-50 | "volitilized" should read --volatilized--. |
| 7 | 22 | "catalyst" should read --catalytic--. |
| 10 | 50 | "105.78%" should read --105.7%--. |
| 15 | 36 | "0492" should read --0429--. |
| 27 | 35 | "catalyst" should read --catalytic--. |
| 28 | 14 | before "catalyst" insert --said--. |
| 28 | 24 | "catalytic" should read --catalyst--. |
| 28 | 49 | "catalyst" should read --catalytic--. |
| 29 | 19 | "mor" should read --more--. |
| 30 | 7 | "catalyst" should read --catalytic--. |
| 30 | 22 | "catalyst" should read --catalytic--. |
| 30 | 37 | "catalyst" should read -- catalytic--. |

Signed and Sealed this

Fourth Day of May, 1993

*Attest:*

Michael K. Kirk

MICHAEL K. KIRK

*Attesting Officer*

*Acting Commissioner of Patents and Trademarks*